US005397022A

United States Patent [19]

Schäfer

[11] Patent Number: 5,397,022

[45] Date of Patent: Mar. 14, 1995

[54] BOX-SHAPED CONTAINERS OF PLASTICS MATERIAL

[75] Inventor: Gerhard Schäfer, Neunkirchen-Salchendorf, Germany

[73] Assignee: Fritz Schafer Gesellschaft mit beschrankter Haftung, Neunkirchen, Germany

[21] Appl. No.: 157,355

[22] Filed: Nov. 23, 1993

Related U.S. Application Data

[63] Continuation of Ser. No. 837,821, Feb. 18, 1992, abandoned.

[30] Foreign Application Priority Data

Feb. 22, 1991 [DE] Germany ..... 41 05 527.6

[51] Int. Cl.[6] ..... B65D 6/00

[52] U.S. Cl. ..... 220/675; 220/1.5; 220/635

[58] Field of Search ..... 220/1.5, 605, 606, 608, 220/623, 635, 675

[56] References Cited

U.S. PATENT DOCUMENTS

| | | | |
|---|---|---|---|
| 3,985,258 | 10/1976 | Quigley et al. | 220/1.5 X |
| 4,000,827 | 1/1977 | Emery | 220/1.5 X |
| 4,197,958 | 4/1980 | Zeni et al. | 220/1.5 X |
| 4,375,265 | 3/1983 | van de Wetering et al. | 220/1.5 |
| 4,775,068 | 10/1988 | Reiland et al. | 220/1.5 X |
| 4,936,615 | 6/1990 | Moore | 220/1.5 X |

*Primary Examiner*—Steven M. Pollard
*Attorney, Agent, or Firm*—Anderson Kill Olick & Oshinsky

[57] ABSTRACT

A box-shaped container of plastics material, particularly a storage and transport container. The container includes a bottom which has a plane upper side and an underside which is stabilized by means of stiffening ribs. Flat webs extend along a bottom edge of the container in direction of the plane of the bottom. The flat webs are supported at a distance underneath the bottom plane by means of additional stiffening ribs which extend transversely of the bottom edge. The flat webs form the bottom surface of the container. Pocket-like free spaces are defined between the underside of the bottom, the upper sides of the flat webs and the transversely directed stiffening ribs. The free spaces are completely open at the bottom edge. The inwardly directed border edges of the flat webs are spaced at a distance from the stiffening ribs on the underside of the bottom which extend parallel to the inner edges, so that downwardly open passages are defined in the pocket-like free spaces at the inwardly directed border edges.

13 Claims, 2 Drawing Sheets

BOX-SHAPED CONTAINERS OF PLASTICS MATERIAL

This is a continuation application of Ser. No. 07/837,821, filed Feb. 18, 1992, now abandoned.

BACKGROUND OF THE INVENTION

1. Field of the Invention

The present invention relates to a box-shaped container of plastics material, particularly a storage and transport container. The container includes a bottom which has a plane upper side and an underside which is stabilized by means of stiffening ribs. Flat webs extend along the bottom edge of the container in direction of the plane of the bottom. The flat webs are supported at a distance underneath the bottom plane by means of stiffening ribs which extend transversely of the bottom edge. The flat webs form the bottom surface of the container. Pocket-like free spaces defined between the underside of the bottom, the upper sides of the flat webs and the transversely directed stiffening ribs are completely open at the side of the bottom edge.

2. Description of the Related Art

Box-shaped containers of the above-described type of plastics material are known from DE-GM 81 37 907 and DE-GM 89 03 430.

The box-like container of this type not only has the advantage that the entire bottom of the container provides a plane support surface for the goods to be stored, but also creates in the region of the flat webs or base ledges located underneath the bottom a support surface for the box-like container itself, wherein this support surface ensures a high stability of the container whether the container is loaded or unloaded.

However, this known type of box-like container has the disadvantage that it cannot be used in those situations in which it is required that the container is always in a completely hygienic condition. This is the case, for example, in the food industry where the box-shaped containers must repeatedly be subjected to cleaning procedures with washing liquids.

In the box-shaped containers of the above-described known type, undesirable residues can remain particularly within the pocket-like free spaces defined between the bottom underside, the upper side of the flat webs and the transversely directed stiffening ribs. These residues can usually not be safely removed during the cleaning procedures which are usually carried out automatically. This is true even if the cleaning liquid is injected in the form of jets into the pocket-like free spaces.

SUMMARY OF THE INVENTION

Therefore, it is the object of the present invention to improve the box-shaped container of the above-described type in such a way that it can be manufactured easily by means of conventional injection molding tools for plastic material and which can be cleaned in practical use at all locations safely and without requiring cumbersome additional manipulations.

In accordance with the present invention, the inwardly directed border edges of the flat webs forming the support surfaces are spaced at a distance from the stiffening ribs on the underside of the bottom which extend parallel to the border edges and downwardly open passages are formed in the pocket-like free spaces at the inwardly directed border edges.

The configuration according to the present invention provides the advantage that the pocket-like free spaces between the bottom underside, the upper side of the flat webs and the transversely directed stiffening ribs can be manufactured by using conventional injection molding tools for plastics material. Moreover, the openings or passages provided at opposite ends of the free spaces enable cleaning liquid to pass through the free spaces almost unobstructed, so that, particularly when the cleaning liquid is injected as liquid jets, all undesirable residues can be washed out of the free spaces.

In accordance with another feature of the present invention, the cleaning procedure can be carried out even more easily if the stiffening ribs extending parallel to the inwardly directed border edges of the flat webs have a sectional height relative to the bottom underside which is smaller than the distance between the flat webs and the bottom underside. Thus, the passages in the free spaces formed at a distance from the bottom edge extend beyond the adjacent stiffening ribs at the bottom underside.

In accordance with another useful feature of the invention, the flat webs are mounted so as to be slightly inclined upwardly relative to the bottom plane from the outer border edge toward the inner border edge. This feature not only ensures that the box-shaped container is conveyed easily and without vibration on conveyors, particularly roller conveyors. In addition, it is ensured that, in the fully loaded state of the box-shaped container, the flat webs serving as bottom surfaces can be deformed at most into an approximately horizontal position in which they form a plane bottom surface. Finally, this feature further ensures a slight drawing or pulling of the mold core when the box-shaped container is manufactured.

It has been found that an angle of inclination of between 1° and 2°, preferably 1.5°, relative to the horizontal is completely sufficient for obtaining the desired results.

It has additionally been found advantageous to make the distance between the stiffening ribs extending transversely of the bottom edge smaller than the spacing between successive rollers of a roller conveyor for conveying the containers. As a result, undesirable bending of the flat webs is prevented and, consequently, a vibration-free movement of the box-shaped containers on the conveyor is achieved.

It is also advantageous in this connection to dimension the width of the flat webs greater than the distance between the stiffening ribs. Preferably, the width of the flat webs is at least twice the distance between the stiffening ribs.

In accordance with another feature of the invention, the stiffening ribs of the bottom are arranged in the middle portion of the bottom in a grate-like crossing configuration and have a section height which decreases toward the middle of the bottom. In some cases, it may also be provided that the distance between the grate-like crossing stiffening ribs decreases toward the middle of the bottom.

In accordance with a preferred feature of the box-shaped container of plastics material according to the present invention, the flat webs extend in the manner of a frame along the longitudinal and transverse edges of the bottom. On the other hand, it is also possible that the flat webs extend merely along the longitudinal edges of the bottom.

Finally, another feature of the present invention provides that, for example, the underside of the flat webs may be corrugated. This feature is provided because it has been found that the adherence of the bottom surface formed by the flat ribs on the storage and conveying means is improved and, in addition, the box-like container travels surprisingly smoothly on the conveying means which results in a reduction of the conveying noise.

The various features of novelty which characterize the invention are pointed out with particularity in the claims annexed to and forming a part of this disclosure. For a better understanding of the invention, its operating advantages attained by its use, reference should be had to the drawing and descriptive matter in which there are illustrated and described preferred embodiments of the invention.

DESCRIPTION OF THE PREFERRED EMBODIMENTS

Figure 1:
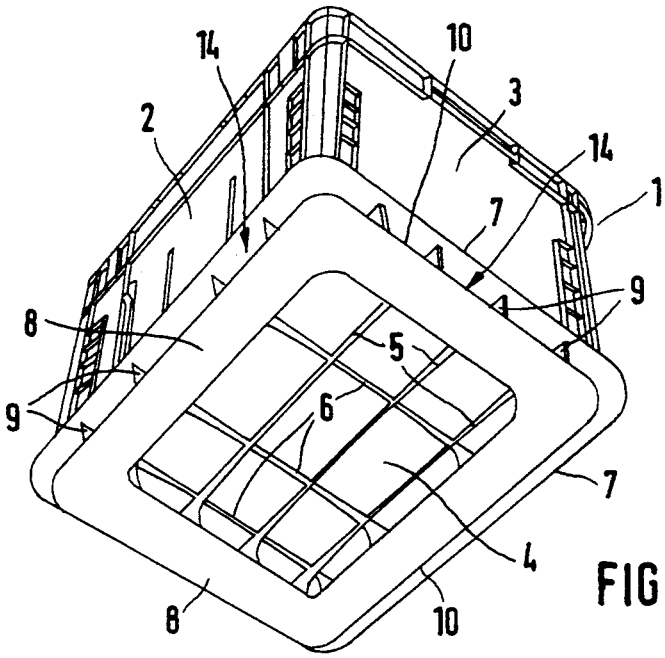
FIG. 1 is a perspective bottom view of a box-shaped container of plastics material according to the present invention.

FIG. 1 of the drawing shows an embodiment of the box-shaped container according to the present invention manufactured as an injection molded article of plastics material. The container 1 is predominantly used as a storage and transport container for use in shelf systems and is particularly suitable for use in shelf systems which include conveyor tracks in addition to automatic feeding and removal units.

It should be mentioned already at this point that the arrangement and configuration of the longitudinal walls 2 and transverse walls 3 of the container 1 are not of significant importance. Rather, the important aspects are the configuration in the region of the container bottom 4 as well as of other structural components and configurations which are attached at the bottom side of the container bottom 4.

Accordingly, the following description is directed primarily to box-shaped containers 1 in which upper longitudinal walls 2 and transverse walls 3 are integrally connected to the container bottom 4. However, the features which will be described in this connection may also be part of stands, pallets or similar storage and transport units which can be manufactured as injection molded article of plastics material.

Figure 3:
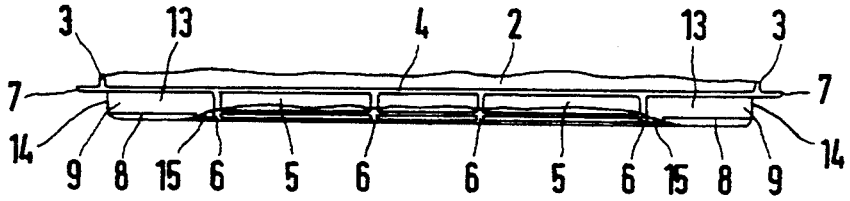
FIG. 3 is a sectional view taken along sectional line III—III of FIG. 2 through the bottom portion of the box-shaped container.
Figure 4:
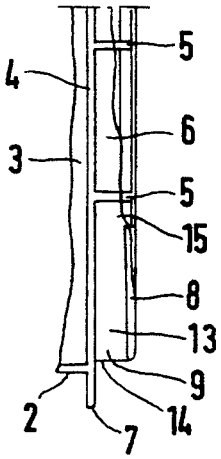
FIG. 4 is a sectional view taken along sectional line IV—IV in FIG. 2 through the bottom portion of the container of FIG. 1.

FIGS. 3 and 4 of the drawing show that the entire upper side of the bottom 4 of the box-shaped container 1 is plane, while the underside of the bottom 4 is stabilized by means of longitudinally extending stiffening ribs 5 and transversely extending stiffening ribs 6 which are integrally connected to the bottom 4.

The outer bottom edge 7 of the bottom 4 may project in the manner of a flange beyond the outer surfaces of the longitudinal walls 2 and transverse walls 3. Flat webs 8 extend along the outer bottom edge 7. The flat webs 8 are supported at a distance underneath the bottom 4 by means of vertical stiffening ribs 9 which extend transversely of the bottom edge 7. The flat webs 8 and the stiffening webs 9 are integrally formed with the box-shaped container 1 or container bottom 4, wherein the stiffening ribs 9 are connected at right angles to the outer stiffening ribs 5 and 6 which extend parallel to the longitudinal walls 2 and the transverse walls 3 of the box-shaped container.

Figure 2:
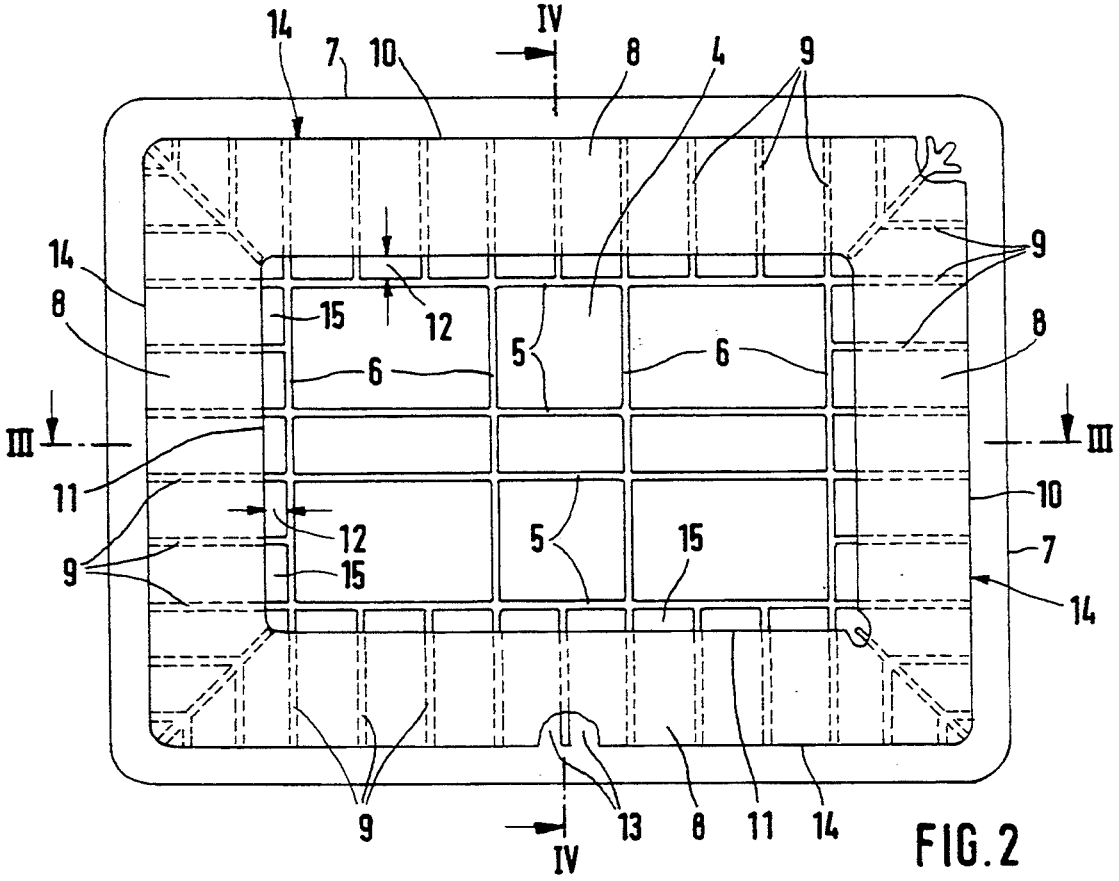
FIG. 2 is a bottom view, on a larger scale, of the box-shaped container of FIG. 1.

In the embodiment of the box-shaped container 1 shown in FIGS. 1 and 2, the flat webs 8 together form a frame which is mounted in such a way that the outer edges 10 of the flat webs are inwardly offset relative to the bottom edge 7, as can be clearly seen in FIG. 2.

On the other hand, the inwardly directed edges 11 of the flat webs 8 are located in such a way that they are spaced by a distance 12 from the outer stiffening ribs 5 and 6 which extend parallel thereto and are provided on the underside of the container bottom 4.

The flat webs 8 form the bottom surfaces of the box-shaped container 1 and define a plurality of pocket-like free spaces 13 together with the transversely directed stiffening ribs 9 and the underside of the container bottom 4. The free spaces 13 are located one next to the other. In the embodiment shown in FIGS. 1 through 4, the pocket-like free spaces 13 are provided in longitudinal direction of the bottom edge 7 as well as along the transverse direction thereof. In the embodiment according to FIG. 5, on the other hand, the pocket-like free spaces 13 are only provided in longitudinal direction of the bottom edge 7.

Each pocket-like free space 13 has at its outer end an opening 14 facing the bottom edge and at its inner end has a downwardly open passage 15 which is determined by the distance 12 between the inner edge 11 and the adjacent stiffening rib 5 or 6 of the bottom 4.

The configuration of the pocket-like free spaces 13 with openings on both ends thereof ensures that washing liquid can be flushed therethrough in an optimum manner and, consequently, any residues which have become stuck in the spaces can be reliably and safely removed.

As can be seen in FIGS. 1, 3 and 4 of the drawing, at least the stiffening ribs 5 and 6 of the container bottom 4 which extend parallel to the inwardly directed edges 11 of the flat webs 8 have a sectional height relative to the underside of the bottom which is slightly smaller than the distance of the flat webs 8 from the underside of the container bottom 4. This configuration further facilitates flushing of the pocket-like free spaces 13 with washing liquid because the discharge of the liquid through the passages 15 is made easier.

FIGS. 3 and 4 of the drawing further show that the flat webs 8 are slightly upwardly inclined relative to the bottom plane from the outer edge 10 toward the inner edge 11. The angle of inclination may be between 1° and 2°, preferably 1.5°. This configuration contributes to an excellent bottom support surface for the box-shaped container 1 even if heavy goods are stored in the container 1. The container bottom 4 can at most bend to such an extent that the flat webs 8 assume a horizontal position.

It has been found useful if the distance between the stiffening ribs 9 directed transversely of the bottom edge 7 is smaller than the usual spacing between successive rollers of a roller conveyor which is used for conveying the containers. Because of the small distance between the stiffening ribs 9, the flat webs 8 cannot bend in an undesirable manner transversely of the plane thereof. As a result, it is ensured that the box-shaped container 1 travels smoothly over the roller conveyors used for conveying the containers.

As additionally illustrated in FIGS. 2 and 4 of the drawing, the width of the flat webs 8 is preferably greater than the distance between the stiffening ribs 9. It has been found advantageous if the width of the flat webs 8 is at least twice the distance between two adjacent stiffening ribs 9.

Figure 5:
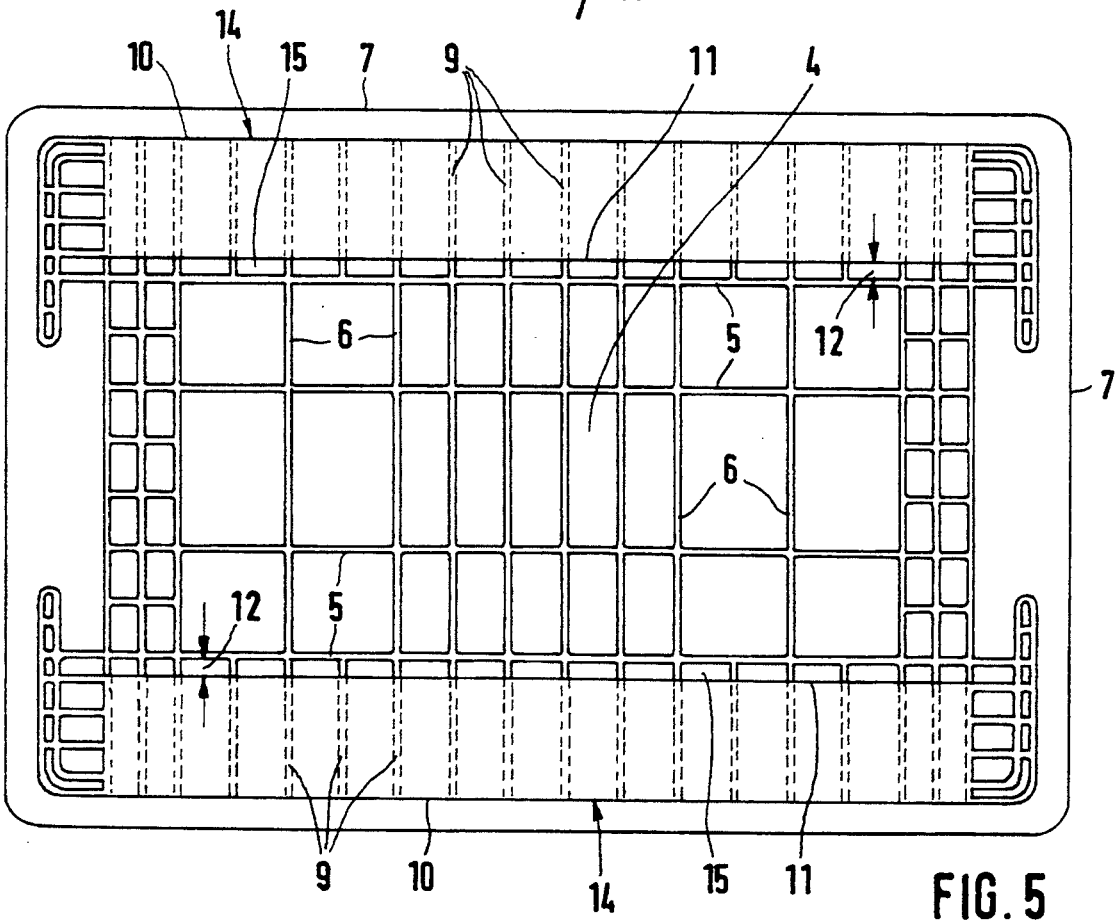
FIG. 5 is a bottom view of a modified embodiment of the box-shaped container according to the present invention.

FIGS. 2 and 5 of the drawing further clearly show that the stiffening ribs 5 and 6 of the bottom have a grate-like intersecting arrangement in the region of the center field of the bottom. In addition, FIGS. 1, 3 and 4 of the drawing show that the sectional height of the stiffening ribs 5 and 6 decreases toward the center of the bottom.

In the embodiment of the box-shaped container 1 shown in FIG. 2, the distance between the grate-like intersecting stiffening ribs 5 and 6 decreases toward the center of the bottom.

In the embodiment of FIG. 5, on the other hand, the stiffening ribs 5 and 6 for the bottom are arranged in such a way that the distance between transversely extending stiffening ribs 6 decreases toward the center of the bottom, while the distance between stiffening ribs 5 increases toward the center of the bottom.

It may be advantageous in many cases to provide the underside of the flat webs 8 which serves as the box-shaped container 1 with roughened portions, i.e., with corrugations or the like. On the one hand, the roughened portions or corrugations increase the adherence of the box-shaped container 1 on support surfaces for the container 1. On the other hand, it has also been found that these roughened portions result in an improvement of the smoothness of travel of the box-shaped container 1 on the conveyor paths of conveying units, for example, roller conveyors because the roughened portions decrease the conveying noise.

Finally, it should be mentioned that a box-shaped container 1 of the type illustrated in FIG. 5 of the drawing can be used to particular advantage in those situations in which shelf systems cooperate with storage and removal units which operate in accordance with the principle of the so-called traction technology.

While specific embodiments of the invention have been shown and described in detail to illustrate the inventive principles, it will be understood that the invention may be embodied otherwise without departing from such principles.

I claim:

1. A plastic box-shaped container molded in one piece as an injection molded part, comprising:

an upper surface of a planar generally horizontal bottom being integral with a bottom edge of a continuous vertical wall, a lower surface of the bottom being integral with top ends of generally vertical first and second stiffening ribs and additional generally vertical ribs;

bottom ends of the additional vertical ribs being integral with an upper surface of a generally horizontal web having a set of four integral peripheral outer edges and a set of four integral inner edges, the additional ribs extending from the outer edge of the web to a point inward of the inner edge; and parallel first ribs and parallel second ribs each inwardly spaced from said integral inner edges of said web and extending from a point inward of an inner edge of the web to another point inward of an opposite inner edge of the web such that the outermost first and second ribs are integral with and extend generally perpendicular to the innermost edges of the additional ribs, the first and second ribs being generally perpendicular to each other, the number of said additional ribs extending parallel to said first ribs or said second ribs being greater than the number of said first ribs or said second ribs, and through passages existing between adjacent additional ribs extending from outside the peripheral outer edges of said web to inside the inner edges of said web.

2. The box-shaped container according to claim 1, wherein the vertical distance between the top end and bottom end of the first and second ribs is less than the vertical distance between the first and second inner edges of the flat webs and the bottom lower surface.

3. The box-shaped container according to claim 1, wherein the web has a slight inclination upwardly relative to the plane of the bottom from the outer edge toward the inner edge.

4. The box-shaped container according to claim 1, wherein the additional ribs are spaced apart by a distance which is smaller than a spacing between successive rollers of a roller conveyor for conveying the box-shaped container.

5. The box-shaped container according to claim 4, wherein the distance between the outer and inner edges of the web is greater than the distance between the additional ribs.

6. The box-shaped container according to claim 5, wherein the distance between the outer and inner edges of the is twice the distance between the additional ribs.

7. The box-shaped container according to claim 1, wherein the ribs on the bottom underside are arranged in a grate-like intersecting configuration in a center field of the bottom, and wherein the stiffening ribs at the bottom underside have a sectional height which is decreasing toward the center of the bottom.

8. The box-shaped container according to claim 7, wherein the intersecting first and second ribs have a spacing therebetween which decreases toward the center which is inward of the inner edges of the web.

9. The box-shaped container according to claim 1, wherein the web extends in the manner of a frame along longitudinal and transverse bottom edges of the bottom.

10. The box-shaped container according to claim 1, wherein the web extends along longitudinal bottom edges of the bottom.

11. The box-shaped container according to claim 1, wherein the web has a lower surface which is provided with roughened portions.

12. The box-shaped container according to claim 11, wherein the roughened portions are corrugations.

13. The box-shaped container according to claim 1, further comprising transverse webs.

* * * * *